US011149224B2

(12) United States Patent
Subramaniyam

(10) Patent No.: US 11,149,224 B2
(45) Date of Patent: Oct. 19, 2021

(54) FUEL ADDITIVE COMPOSITIONS, AND METHOD OF USE THEREOF

(71) Applicant: Dorf Ketal Chemicals FZE, Fujairah (AE)

(72) Inventor: Mahesh Subramaniyam, Mumbai (IN)

(73) Assignee: Dorf Ketal Chemicals FZE, Fujairah (AE)

( * ) Notice: Subject to any disclaimer, the term of this patent is extended or adjusted under 35 U.S.C. 154(b) by 0 days.

(21) Appl. No.: 16/648,068

(22) PCT Filed: Nov. 5, 2018

(86) PCT No.: PCT/IB2018/058676
§ 371 (c)(1),
(2) Date: Mar. 17, 2020

(87) PCT Pub. No.: WO2019/097353
PCT Pub. Date: May 23, 2019

(65) Prior Publication Data

US 2020/0277538 A1 Sep. 3, 2020

(30) Foreign Application Priority Data

Nov. 17, 2017 (IN) ..... 201721041306

(51) Int. Cl.

| | |
|---|---|
| ***C10L 10/06*** | (2006.01) |
| ***C10L 1/185*** | (2006.01) |
| ***C10L 1/198*** | (2006.01) |
| ***F02M 65/00*** | (2006.01) |
| ***C10L 10/04*** | (2006.01) |

(52) U.S. Cl.
CPC ..... *C10L 10/06* (2013.01); *C10L 1/1852* (2013.01); *C10L 1/1985* (2013.01); *C10L 10/04* (2013.01); *F02M 65/007* (2013.01)

(58) Field of Classification Search
CPC ..... C10L 10/04; C10L 10/06; C10L 1/1852; C10L 1/1985; F02M 65/007
See application file for complete search history.

(56) References Cited

FOREIGN PATENT DOCUMENTS

| | | | | |
|---|---|---|---|---|
| AT | 298934 B | | 5/1972 | |
| CA | 1284584 | * | 6/1991 | |
| CA | 1284584 C | * | 6/1991 | ..... C10L 1/1857 |
| EP | 2796446 A1 | | 10/2014 | |
| IN | 201721041306 | | 11/2017 | |
| WO | 2015124584 A1 | | 8/2015 | |
| WO | 2019097353 A1 | | 5/2019 | |

OTHER PUBLICATIONS

Patrick T. Lang, Andrew M. Harned, and Jane E. Wissinger, Oxidation of Borneol to Camphor Using Oxone and Catalytic Sodium Chloride: A Green Experiment for the Undergraduate Organic Chemistry Laboratory, J. Chem. Educ. 2011,88, 5, 652-656 (Year: 2011).*

Foreign communication from the priority International Application No. PCT/IB2018/058676, International Search Report and Written Opinion, Feb. 11, 2019, 9 pages.

Foreign communication from the priority International Application No. PCT/IB2018/058676, International Preliminary Report on Patentability, May 20, 2019, 11 pages.

* cited by examiner

*Primary Examiner* — Ellen M McAvoy
*Assistant Examiner* — Ming Cheung Po
(74) *Attorney, Agent, or Firm* — Conley Rose, P.C.; Rodney B. Carroll

(57) ABSTRACT

The present invention relates to a fuel additive composition for controlling formation of deposits and for reducing already formed deposits formed in a fuel injection system and engine, or in an internal combustion engine, wherein the fuel additive composition comprises oxide derivative of (a) iso-borneol or (b) borneol, and to a method of use thereof. In one embodiment, the present invention relates to a fuel additive composition for controlling formation of deposits and for reducing already formed deposits formed in a fuel injection system and engine, or in an internal combustion engine, wherein the fuel additive composition comprises (a) iso-borneol or (b) borneol, and to a method of use thereof. In one embodiment, the present invention relates to a fuel additive composition for controlling formation of deposits and for reducing already formed deposits formed in a fuel injection system and engine, or in an internal combustion engine, wherein the fuel additive composition comprises a mixture of oxirane or an oxide compound with (a) iso-borneol or (b) borneol, and to a method of use thereof. In one embodiment, the present invention relates to a composition comprising a fuel and the fuel additive composition of the present invention.

8 Claims, No Drawings

FUEL ADDITIVE COMPOSITIONS, AND METHOD OF USE THEREOF

CROSS REFERENCE TO RELATED APPLICATIONS

This application is a filing under 35 U.S.C. 371 of International Application No. PCT/IB2018/058676 filed Nov. 5, 2018, entitled "Fuel Additive Compositions, and Method of Use Thereof," which claims priority to Indian Patent Application No. 201721041306 filed Nov. 17, 2017, which applications are incorporated by reference herein in their entirety.

FIELD OF THE INVENTION

The present invention relates to fuel additive compositions, and method of use thereof.

In particular, the present invention relates to fuel additive compositions for controlling formation of deposits, and for reducing already formed deposits formed in a fuel injection system and engine, or in an internal combustion engine, and method of use thereof.

BACKGROUND OF THE INVENTION

The fuel injection system and engine are designed to provide improved vehicle emission control, fuel performance, fuel economy, and durability. However, on combustion of fuel, deposits get formed in the fuel delivery system such as in fuel injectors, in intake valve, and/or in a combustion chamber, and interfere with the functioning of the engine, and therefore lead to incomplete combustion of the fuel resulting in higher engine out emission, reduced power and poorer fuel economy.

Combustion chamber deposit interference (CCDI) and combustion chamber deposit flaking (CCDF) are engine deposit problems that can occur in some engines. The CCDI may manifest itself as cold engine banging noise, resulting from physical contact between engine deposits on the piston top and cylinder head in some engine designs. The CCDF occurs when combustion chamber deposits flake off and lodge between the valve face and valve seat, causing low compression pressures due to poor valve sealing.

The fuel injectors, carburetors and intake valves are also regions of concern where deposit formation can occur. The deposits in small fuel passages of fuel injectors, such as pintle injector deposits, can reduce fuel flow and alter the spray pattern, which can adversely affect power, fuel economy, and engine driveability. The deposits can cause similar problems for carbureted engines as carburetors also use small channels and orifices to meter fuel. Further, the deposits formed in intake valves will alter the fuel to air stoichiometry leading to incomplete combustion, which in turn may lead to increased engine out emissions and reduced engine efficiency.

In recent times, some of the additive compositions for controlling the formation of deposits in an internal combustion engine have been provided.

One of the presently known additive compositions comprises a reaction product of ethylene diamine (EDA), polyisobutylene (PIB) phenol, and formalin, that is, a nitrogen containing additive. When the inventor of the present invention made such known additive composition by reacting ethylene diamine (EDA), polyisobutylene (PIB) phenol, and formalin in a mole ratio of about 1:2:2, then he has found that such known additive composition (the comparative prior art additive composition) does not solve the above-discussed industry problems because even with about 93 ppm dosage of the comparative prior art additive composition, the intake valve deposits (IVD) is reduced from 149 mg/v for blank test to 98 mg/v for the fuel treated with the comparative prior art additive composition, and the combustion chamber deposits (CCD) is reduced from 6367 mg/engine for blank test to 5433 mg/engine for the fuel treated with the comparative prior art additive composition when tested by the "Mercedes" test, M102E (CEC-05-A-93) engine cleanliness evaluation test indicating no improvement over base value. Accordingly, the inventor observes that such known prior art additive composition cannot be a preferred choice for the industry.

Therefore, there is still a scope of developing an improved additive composition for controlling formation of deposits and for reducing the already formed deposits from the fuel injection system and/or the combustion chamber, which can become a preferred choice for the industry to solve above-discussed industrial problems, a reference to which is drawn herein.

NEED OF THE INVENTION

Therefore, the industry needs additive compositions for controlling the formation of deposits and for reducing the already formed deposits in the fuel injection system and engine, or in the internal combustion engine which can solve one or more of the above-discussed industrial problems, a reference to which is drawn herein.

Problem to be Solved by the Invention

Therefore, the present invention aims at providing a solution to the above-discussed existing industrial problems, a reference to which is drawn herein, by providing fuel additive compositions for controlling formation of deposits and for reducing already formed deposits formed in a fuel injection system and engine, or in an internal combustion engine.

OBJECTS OF THE INVENTION

Therefore, main object of the present invention is to provide fuel additive compositions for controlling formation of deposits and for reducing already formed deposits formed in a fuel injection system and engine, or in an internal combustion engine which can solve one or more of the above-discussed industrial problems, a reference to which is drawn herein.

Another object of the present invention is to provide fuel additive compositions for controlling formation of deposits and for reducing already formed deposits formed in a fuel injection system and engine, or in an internal combustion engine so that vehicle emissions get controlled, and fuel performance, fuel economy, and durability is improved or at least not lost.

Yet another object of the present invention is to provide a method of use of the fuel additive compositions of the present invention for controlling formation of deposits and for reducing already formed deposits formed in a fuel injection system and engine, or in an internal combustion engine so that vehicle emissions get controlled, and fuel performance, fuel economy, and durability is improved or at least not lost.

Still another object of the present invention is to provide fuel additive compositions for controlling formation of deposits and for reducing already formed deposits formed in a fuel injection system and engine, or in an internal combustion engine so that the intake valve deposits (IVD) performance, and/or combustion chamber deposits (CCD) performance is improved as compared to the known additive.

Still another object of the present invention is to provide fuel additive compositions for controlling formation of deposits and for reducing the already formed deposits in the fuel delivery system and combustion chamber of the internal combustion engine.

Other objects and advantages of the present invention will become more apparent from the following description when read in conjunction with examples, which are not intended to limit scope of present invention.

DETAILED DESCRIPTION OF THE INVENTION

With aim to overcome the above-discussed industrial problems of the prior art and to achieve the above-discussed objects of the present invention, the inventor has, surprisingly and unexpectedly, found that when a non-nitrogen additive is added to a fuel it not only solves problems of formation of deposits in the fuel injection system and engine, or in the internal combustion engine, but also avoids release (formation) of nitrogen oxide (NOX). The inventor has found that such non-nitrogen additive comprises borneol or isoborneol. As can be observed the borneol or the isoborneol is a non-nitrogen additive, which does not release NOX.

Therefore, in one embodiment, the present invention relates to a fuel additive composition for controlling formation of deposits and for reducing already formed deposits formed in a fuel injection system and engine, or in an internal combustion engine, wherein the fuel additive composition comprises the borneol or the isoborneol.

In accordance with one of the embodiments of the present invention, the isoborneol has International Union of Pure and Applied Chemistry (IUPAC) name as (1R,3R,4R)-4,7,7-trimethylbicyclo[2.2.1]heptan-3-ol.

In accordance with one of the embodiments of the present invention, the isoborneol may comprise (a) D-isomer of borneol, (b) L-isomer of borneol, or (c) a mixture thereof.

The inventor has further found that when the borneol or the isoborneol is combined with an oxirane compound or preferably when an oxide derivate of the borneol or the isoborneol is used then, surprisingly and unexpectedly, the above-discussed industrial problems of formation of deposits in the fuel injection system and engine, or in the internal combustion engine are further resolved without addition of or formation of (additional) nitrogen oxide (NOX) in the system. The inventor has further found that the oxirane or oxide compound which may be used may be selected from the group comprising ethylene oxide, propylene oxide, butylene oxide, or any such other oxide compound.

Therefore, in another embodiment, the present invention relates to a fuel additive composition for controlling formation of deposits and for reducing already formed deposits formed in a fuel injection system and engine, or in an internal combustion engine, wherein the fuel additive composition comprises at least a combination of the borneol or the isoborneol and an oxirane compound.

In accordance with one of the preferred embodiments of the present invention, the oxirane compound is selected from the group comprising ethylene oxide, propylene oxide, butylene oxide, and any such other oxide compound.

Therefore, in another embodiment, the present invention relates to a fuel additive composition for controlling formation of deposits and for reducing already formed deposits formed in the fuel injection system and engine, or in the internal combustion engine, wherein the fuel additive composition comprises an oxide derivative of the borneol or the isoborneol.

In accordance with one of the preferred embodiments of the present invention, the oxide derivative of the borneol or the isoborneol is a reaction product of the borneol or the isoborneol and an oxirane or oxide compound.

In accordance with one of the preferred embodiments of the present invention, the oxirane or oxide compound is selected from the group comprising ethylene oxide, propylene oxide, butylene oxide, and any such other oxide compound.

In accordance with one of the embodiments of the present invention, the oxirane compound is reacted with the isoborneol or the borneol resulting in formation of the oxide derivative of the isoborneol or the borneol.

According to one of the embodiments of the present invention, the borneol or the isoborneol and the oxirane compound may be mixed together in a mole ratio varying from about 1:1 to 1:50 to arrive at the fuel additive composition of the present invention comprising at least a combination of the borneol or the isoborneol and the oxirane compound.

According to one of the preferred embodiments of the present invention, the oxirane compound is reacted with the isoborneol or the borneol resulting in formation of the oxide derivative of the isoborneol or the borneol.

According to one of the embodiments of the present invention, the oxirane compound may be reacted with the isoborneol or the borneol to form the oxide derivative of the isoborneol or the borneol by any method known in the art.

According to one of the preferred embodiments of the present invention, the borneol or the isoborneol and the oxirane or oxide compound may be reacted in a mole ratio varying from about 1:1 to 1:50 to arrive at the fuel additive composition of the present invention comprising the oxide derivative of the borneol or the isoborneol.

In accordance with one of the embodiments of the present invention, the oxide derivative of the borneol or the isoborneol may be prepared by any method known in the prior art. It may be prepared by reacting or treating the borneol or the isoborneol with an oxirane or oxide compound. Accordingly, the scope of the present invention is not limited by a method to prepare the oxide derivative of the borneol or the isoborneol of the present invention.

According to one of the embodiments of the present invention, the fuel additive composition of the present invention may further comprise one or more of an additional compound selected from the group comprising antioxidant, corrosion inhibitor, foam inhibitors, scale inhibitor, gas-hydrate inhibitor, dispersant, pour point depressant, demulsifier, viscosity modifier, friction modifier, metal deactivator, extreme pressure agent, antiwear agent, seal swelling agent, wax control polymer, and a mixture thereof.

According to one of the embodiments of the present invention, the fuel additive composition of the present invention may further comprise one or more of blending agents including fuel-soluble alkanols which may be selected from the group comprising methanol, ethanol, and their higher homologs, and fuel-soluble ethers which may be selected from the group comprising methyl tertiary butyl ether, ethyl tertiary butyl ether, methyl tertiary amyl ether, and analogous compounds, and a mixture thereof.

According to one of the embodiments of the present invention, the additive compositions of the present invention may be used with fuel comprising any and all base fuels suitable for use in the operation of spark ignition internal combustion engines which may be selected from the group comprising unleaded motor and aviation gasoline, and reformulated gasoline which may typically contain both hydrocarbons of the gasoline boiling range and fuel soluble oxygenated blending components selected from the group comprising alcohol, ether, and other suitable oxygen-containing organic compound.

Accordingly, in one of the embodiments of the present invention, it also relates to a composition comprising a fuel and the fuel additive composition of the present invention.

According to one of the embodiments of the present invention, the additive composition of the present invention may be blended into the fuel individually or in various sub-combinations.

Accordingly, in one of the embodiments of the present invention, it also relates to a method for controlling formation of deposits and for reducing already formed deposits formed in a fuel injection system and engine, or in an internal combustion engine, wherein the method comprises treating the fuel with the fuel additive composition of the present invention as described herein.

Accordingly, in one of the embodiments of the present invention, it also relates to a method of using a fuel additive composition for controlling formation of deposits and for reducing already formed deposits formed in a fuel injection system and engine, or in an internal combustion engine, wherein the method comprises treating the fuel with the fuel additive composition of the present invention as described herein.

The inventor has found that the fuel additive composition of the present invention overcomes the above-discussed industrial problems and has been found to be suitable for controlling (or preventing) formation of deposits and for reducing (or removing) the already formed deposits formed in the fuel injection system and engine, or in the internal combustion engine in such a manner that the intake valve deposits (IVD) performance, and the combustion chamber deposits (CCD) performance is improved at least as compared to the above-discussed known prior art additive.

The performance and effectiveness of the fuel additive composition of the present invention can be assessed by existing methods. For example, it may be assessed by using a range of industry standard tests, such as, Mercedes Benz test M102E (CEC-F-05-93), Mercedes Benz test M111 (CEC-F-20-98), BMW 318i or Ford 2.3 L test by measuring performance of the additive to control intake valve deposits (IVD), and/or to control combustion chamber deposits (CCD). The engine cleanliness performance and effectiveness of fuel containing the fuel additive composition may be assessed by using a range of industry standard tests. For example, by using Peugeot XUD9 test and Peugeot DW10B test by measuring its ability to control and reduce injector deposits. The performance and effectiveness of the fuel additive composition and the engine cleanliness performance and effectiveness of fuel containing the fuel additive composition of the present invention may be assessed by using any fuel. For example, it can be assessed by using a fuel RF-12-09—a gasoline fuel having oxygen content of about <2.7% m/m (w) when measured by EN ISO 22854, density @ 150 C varying from about 720 to about 775 kg/m3 when measured by EN ISO 12185, or fuel RF-02-03—a gasoline fuel having oxygen content of about <0.1% m/m (w) when measured by EN 1601, density @ 150 C varying from about 748 to about 754 kg/m3 when measured by ISO 12185 or ISO 3675.

It may be noted that the scope of the present invention is not limited to the test method and the fuel used.

It may be noted that the scope of the present invention is not limited to a specific fuel, but it is intended to cover a fuel which includes, without limitation, gasoline, middle-distillate, heavy-distillate, bunker fuel, marine fuel, which may contain hydrocarbons, oxygenates, biomass and one or more of co-additives such as gasoline carrier fluid, demulsifier, corrosion inhibitor, friction modifier, antifoam, combustion improver, cetane improver, lubricity improver, middle distillate flow improvers and wax anti settling additives.

The inventor has demonstrated the above-discussed advantages of the fuel additive composition of the present invention by way of the following examples, which are for the illustration purpose and not intended to limit scope of the present invention.

EXAMPLES

As described herein above, the comparative prior art additive was prepared by reacting ethylene diamine (EDA), polyisobutylene (PIB) phenol, and formalin in a mole ratio of about 1:2:2, wherein the polyisobutylene (PIB) phenol is prepared by reacting phenol and commercially known and available high reactive PIB (HRPIB) having molecular weight of about 950 Dalton. The obtained reaction product was found to have molecular weight of about 3574 Dalton when measured by gel permeation chromatography (GPC).

The invention additive was obtained by reacting isoborneol and propylene oxide in a mole ratio of about 1:1.5 using KOH as a catalyst, wherein the isoborneol used had molecular weight of about 154 when measured by GPC, and the propylene oxide had a molecular weight of about 58 when measured by GPC. To obtain this invention additive, about 200 g (1.30 moles, 12.80 wt %) of isoborneol was reacted with about 1157 g (19.94 moles, 73.98 wt %) of propylene oxide, and the obtained invention additive was found to have molecular weight of 3009 Dalton when measured by gel permeation chromatography (GPC).

The performance and effectiveness of gasoline fuel additive compositions was assessed by the "Mercedes" test, M102E (CEC-05-A-93) and Mercedes Benz test M111 (CEC-F-20-98), engine cleanliness evaluation test by measuring performance of the additive to control intake valve deposits (IVD), and to control combustion chamber deposits (CCD) and compared with a blank sample of fuel. The fuel used in these examples was a gasoline fuel (RF-02-03).

As discussed herein above, with about 93 ppm dosage, the comparative prior art additive composition resulted in reduction of the IVD from 149 mg/v for blank test to 98 mg/v for the fuel treated with the comparative prior art additive composition, and in reduction of the CCD from 6367 mg/engine for blank test to 5433 mg/engine for the fuel treated with the comparative prior art additive composition indicating no improvement over base value with the comparative prior art additive composition.

On the contrary, just with about 20 ppm dosage, the invention additive composition, surprisingly and unexpectedly, resulted in reduction of the IVD from 149 mg/v for blank test to 66 mg/v for the fuel treated with the invention additive composition, and in reduction of the CCD from 6367 mg/engine for blank test to 4126 mg/engine for the fuel treated with the invention additive composition indicating improvement over base value with the invention additive composition.

Similarly, when tests were conducted with M111 test method, just with about 20 ppm dosage, the invention additive composition, surprisingly and unexpectedly, resulted in reduction of the IVD from 132 mg/v for blank test to 95 mg/v, and with about 60 ppm dosage, the invention additive composition, surprisingly and unexpectedly, resulted in reduction of the IVD from 132 mg/v for blank test to 83 mg/v, and with about 100 ppm dosage, the invention additive composition, surprisingly and unexpectedly, resulted in reduction of the IVD from 132 mg/v for blank test to 66 mg/v for the fuel treated with the invention additive composition indicating improvement over base value with the invention additive composition.

Accordingly, the surprising and unexpected technical advantages of the present invention have been demonstrated for controlling formation of deposits and for reducing the already formed deposits in the fuel injection system and engine, or in the internal combustion engine with improved reduction in IVD and CCD.

The invention claimed is:

1. A fuel additive composition for controlling formation of deposits and for reducing already formed deposits formed in a fuel injection system and engine, or in an internal combustion engine, wherein the fuel additive composition comprises oxide derivative of (a) iso-borneol or (b) borneol;

wherein the oxide derivative of (a) iso-borneol or (b) borneol is a reaction product of an oxirane compound and the isoborneol or the borneol;

wherein the oxirane compound is selected from the group consisting of (i) ethylene oxide, (ii) propylene oxide, and (iii) butylene oxide.

2. The fuel additive composition as claimed in claim 1, wherein the isoborneol or the borneol are reacted with the oxirane compound in a mole ratio varying from about 1:1 to 1:50.

3. A composition comprising a fuel and the fuel additive composition as claimed in claim 1.

4. A method for controlling formation of deposits and for reducing already formed deposits formed in a fuel injection system and engine, or in an internal combustion engine, wherein the method comprises treating the fuel with the fuel additive composition as claimed in claim 1.

5. A method of using a fuel additive composition for controlling formation of deposits and for reducing already formed deposits formed in a fuel injection system and engine, or in an internal combustion engine, wherein the method comprises treating the fuel with the fuel additive composition as claimed in claim 1.

6. A composition comprising a fuel and the fuel additive composition as claimed in claim 2.

7. A method for controlling formation of deposits and for reducing already formed deposits formed in a fuel injection system and engine, or in an internal combustion engine, wherein the method comprises treating the fuel with the fuel additive composition as claimed in claim 2.

8. A method of using a fuel additive composition for controlling formation of deposits and for reducing already formed deposits formed in a fuel injection system and engine, or in an internal combustion engine, wherein the method comprises treating the fuel with the fuel additive composition as claimed in claim 2.

* * * * *